US010758020B2

(12) United States Patent
Grienay et al.

(10) Patent No.: US 10,758,020 B2
(45) Date of Patent: Sep. 1, 2020

(54) DEVICE FOR TREATING THE HAIR COMPRISING A LATERALLY INSERTING REFILL

(71) Applicants: L'OREAL, Paris (FR); SEB S.A., Ecully (FR)

(72) Inventors: Arnaud Grienay, Lyons (FR); Eddy Ngo, Lyons (FR); Martial Maisonneuve, Villefontaine (FR); Régis Fereyre, Chavanay (FR); Edouard Messager, Asnieres sur Seine (FR); Anne Debauge, Saint-Ouen (FR)

(73) Assignee: L'OREAL, Paris (FR)

( * ) Notice: Subject to any disclaimer, the term of this patent is extended or adjusted under 35 U.S.C. 154(b) by 406 days.

(21) Appl. No.: 15/568,019

(22) PCT Filed: Apr. 20, 2016

(86) PCT No.: PCT/EP2016/058786
§ 371 (c)(1),
(2) Date: Oct. 20, 2017

(87) PCT Pub. No.: WO2016/170002
PCT Pub. Date: Oct. 27, 2016

(65) Prior Publication Data

US 2018/0116362 A1 May 3, 2018

(30) Foreign Application Priority Data

Apr. 20, 2015 (FR) ..... 15 53485

(51) Int. Cl.
*A45D 37/00* (2006.01)
*A45D 2/00* (2006.01)
(Continued)

(52) U.S. Cl.
CPC ..... *A45D 2/001* (2013.01); *A45D 1/00* (2013.01); *A45D 1/04* (2013.01); *A45D 1/06* (2013.01);
(Continued)

(58) Field of Classification Search
CPC ... A45D 1/00; A45D 1/04; A45D 1/06; A45D 1/08; A45D 2001/008; A45D 2/001; A45D 2/40; A45D 19/16; A45D 2019/0041
See application file for complete search history.

(56) References Cited

U.S. PATENT DOCUMENTS 2,299,296 A 10/1942 Battle
2009/0252247 A1 1/2009 Yde et al.
(Continued)

FOREIGN PATENT DOCUMENTS

DE 202011050477 U1 9/2012
EP 2397045 A1 12/2011
(Continued)

OTHER PUBLICATIONS

International Search Report for PCT/EP2016/058786 dated Jul. 8, 2016 (2 pages).
(Continued)

*Primary Examiner* — Rachel R Steitz
(74) *Attorney, Agent, or Firm* — Shumaker, Loop & Kendrick, LLP

(57) ABSTRACT

The invention relates to a device for treating the hair including a first and a second arm connected together by a joint and able to move with respect to one another between a closed configuration for treating the hair and a spread configuration for engaging between them the hairs to be treated. The device also includes a refill including a body having a housing, a member for applying a cosmetic product
(Continued)

received in the housing. The refill includes at least one first mounting means engaging with at least one second mounting means of the first arm, in such a way that the assembly of the first and second mounting means is performed by moving the first mounting means along an axis (Y) substantially parallel to the joint, relative to the second mounting means.

15 Claims, 5 Drawing Sheets

(51) Int. Cl.

| | |
|---|---|
| ***A45D 1/04*** | (2006.01) |
| ***A45D 19/16*** | (2006.01) |
| ***A45D 1/06*** | (2006.01) |
| ***A45D 1/00*** | (2006.01) |
| ***A45D 2/40*** | (2006.01) |
| *A45D 19/00* | (2006.01) |

(52) U.S. Cl.
CPC ..... *A45D 2/40* (2013.01); *A45D 19/16* (2013.01); *A45D 2001/008* (2013.01); *A45D 2019/0041* (2013.01)

(56) References Cited

U.S. PATENT DOCUMENTS

| | | | | |
|---|---|---|---|---|
| 2013/0153461 | A1* | 6/2013 | Hein | A45D 6/00 206/581 |
| 2013/0192625 | A1* | 8/2013 | Migliori | A45D 2/001 132/211 |

FOREIGN PATENT DOCUMENTS

| | | | |
|---|---|---|---|
| EP | 2016/058786 | A1 | 7/2016 |
| FR | 2999884 | A1 | 6/2014 |
| JP | 2006 000412 | A | 1/2006 |
| WO | 2009/015027 | A2 | 1/2009 |
| WO | 2009/078046 | A1 | 6/2009 |
| WO | 2013/045331 | A1 | 4/2013 |

OTHER PUBLICATIONS

Korean Office Action dated Aug. 22, 2018 for Korean Patent Application No. 10-2017-7031783 (9 pages including English Translation).

* cited by examiner

DEVICE FOR TREATING THE HAIR COMPRISING A LATERALLY INSERTING REFILL

The present invention relates to devices for treating the hair, and more particularly, but not exclusively, those intended for shaping the hair, in particular those intended for straightening, curling or crimping the hair, comprising a removable refill of cosmetic product, and to the corresponding refills of cosmetic product.

BACKGROUND

Usually, hair straighteners consist of two arms that are connected together with the aid of a hinge which makes it possible to open and close said arms, and of at least one heating element disposed on the arms. During operations of styling a lock of hair, said lock is introduced between the two arms in the open position and then the two arms are closed manually over the lock of hair. The lock of hair is then subjected to the heat output by the heating element, until the two arms are opened and the lock of hair is removed.

Application WO 2009/078046 describes a hairstyling appliance comprising two arms that are connected together so as to allow the appliance to be opened and closed, at least one heating member and at least one seat for accommodating a hair treatment device, the hair treatment device allowing a haircare product to be dispensed during operation. The hair treatment device is composed of a support material impregnated with a haircare product and suitable for a single use.

WO 2009/015027 and US 2009/0025247 disclose a hair-straightening device that makes it possible to apply a haircare product by contact with the hair. The haircare product to be applied is contained in a removable refill for the application thereof. The removable refill comprises a reservoir containing the haircare product in a gelled form, and orifices for dispensing and applying the product, said orifices being made directly through a wall of the reservoir. The refill is introduced into a housing disposed on one of the two arms of the hair straightener, by sliding along the axis of the arm over which it extends.

FR 2 999 884 discloses a hair-straightening device that enables steam to be sprayed on the hair.

Application WO 2013/045331 discloses an applicator for applying a care substance to the hair, comprising a refill of care substance held in a housing of the applicator. The cartridge comprises a porous support saturated with the care substance.

Application WO 2013/090896 relates to an appliance for treating the hair, in particular a hairstyling appliance, comprising a treatment agent support, in particular a saturated porous material, to be applied to the hair or the skin. The support is fixed to an accessory, which is itself mounted in a removable manner on a hair treatment appliance. The support is T-shaped, allowing it to be mounted in a complementary groove in the accessory.

Patent application EP 2 397 045 relates to a hair-straightening device comprising a removable accessory having an absorbent material supplied with liquid by a reservoir.

There is a need to further improve devices for applying a haircare product such that the user can easily refill the device with haircare product and/or change the haircare product to be applied.

SUMMARY

According to a first of its aspects, a subject of the invention is a device for treating the hair, comprising:

- a first arm and a second arm that are connected together by a joint and are able to move relative to one another between a closed configuration for treating the hair and a spread configuration for engaging hair to be treated between said arms, and
- a removable refill comprising
  - a body having a housing, and
  - a member for applying a cosmetic product received in the housing, the refill comprising at least a first mounting means interacting with at least a second mounting means of the first arm, such that the first and second mounting means are assembled by a movement of the first mounting means, along an axis substantially parallel to the joint, relative to the second mounting means.

A refill of this type is easy to mount on the treatment device by simply moving the refill relative to the first arm. It suffices to cause the first mounting means to interact with the second mounting means via a movement of the refill along an axis substantially parallel to the joint between the two arms.

In addition, it is possible, if desired, when the refill is mounted on the device in this way, to produce the refill such that it maintains a surface, of non-negligible extent, turned toward the exterior and visible to the user. This surface can serve as a holder for information intended for the user, relating for example to the type of composition contained in the refill and/or acting as a reminder for the user of the refill manufacturer's trademark.

Lastly, the user can easily see that the refill is present.

The second mounting means may have at least one surface interacting by snap-fitting and/or friction with a corresponding surface of the first mounting means; better still, the second mounting means has at least two surfaces each interacting by snap-fitting and/or friction with a corresponding surface of the first mounting means.

Preferably, one of the first mounting means and of the second mounting means comprises two facing walls that between them enclose a support of the other of the first mounting means and of the second mounting means. The walls are thus positioned on either side of the support and in particular make it possible for the refill to be held on the first arm. Preferably, the first mounting means comprises the two walls and the second mounting means comprises the support.

Preferably, the space defined between the two walls and the support are of complementary form such that the two walls are able to engage on either side of the support. The two walls may be substantially parallel and in particular be spaced apart by a distance e of between 0.5 mm and 10 mm, better still between 1 mm and 5 mm.

The support may be of a constant thickness d substantially equal to the distance e between the two walls.

The refill may be held on the first arm by friction between the first mounting means and the second mounting means and/or by interaction, particularly by snap-fitting, of a locking member of the first mounting means with a complementary locking member of the second mounting means.

For example, the walls are capable of being slightly spaced-apart from one another upon mounting of the support between them, such that the refill is locked on the first arm by friction between the walls and the support.

In a variant, at least one of the walls comprises a locking relief, forming one of the two locking members, interacting with a complementary relief of the support forming the other of the locking members. Preferably, one of the locking relief and of the complementary relief is a projecting relief and the other of the locking relief and of the complementary relief is a hollowed-out relief.

At least one of the walls may comprise at least one guide part taking up mechanical stress and at least one locking part for preventing detachment of the refill. The locking part may comprise at least one locking relief interacting with a complementary relief of the support.

The first arm or the refill that carries the support may comprise at least one notch for manually unlocking the locking part, in particular a notch allowing a fingernail to be inserted in a groove or under a rib of one of the walls in order to lift it, with a view to unlocking the locking member.

Preferably, the first mounting means is the same length as the second mounting means. The first mounting means may extend over a length substantially equal to the length of the refill.

The first mounting means may have a width l of between 0.5 mm and 50 mm, better still between 2 mm and 30 mm. The second mounting means may have a width substantially equal to or greater than that of the first mounting means.

The first arm may comprise a recess which receives the refill and in which the first and the second mounting means extend. Preferably, the recess is delimited by two opposite surfaces and a bottom.

The first or the second mounting means may extend substantially over the entire length of the recess, in particular between the two opposite surfaces of the latter.

In the use position, the refill may extend between the two opposite surfaces and abut against the bottom. Preferably, the length L of the refill is substantially equal to the length of the recess defined between the two opposite surfaces of the latter.

The refill may comprise a tongue extending along a surface of the refill oriented toward the exterior of the device when the refill is mounted on the first arm. A tongue of this type enables the user to easily remove the refill from the first arm. Said user is able to take hold of the tongue with his hand and pull it upward in order to disengage the first mounting means from the second mounting means.

Preferably, the housing of the application member is oriented toward the second arm. Thus, the application member is facing the second arm and the cosmetic product can be applied to the hair between the two arms after closure of the arms. The second arm may comprise a press member against which the application member bears.

Preferably, the application member is made from a porous material or, in particular, from synthetic or natural fibers or foam.

The application member is preferably impregnated with cosmetic product, in particular a liquid cosmetic.

The application member is preferably configured for applying a product in liquid form to the hair, in particular by contact between the application member and the hair.

The arm opposite the one on which the refill is disposed may have a steam outlet.

Preferably, in particular when the intention is to straighten the hair, the device comprises a heating element intended to come into contact with the hair, and better still two heating elements, each disposed on a respective arm. This or these heating element(s) may each comprise a plate, made of a material that is a good conductor of heat, that defines a hot surface for bringing into contact with the hair, the temperature of said surface being for example greater than or equal to 95° C., better still between 90 and 230° C.

Preferably, product is applied to the lock of hair introduced into the device prior to the application of steam and/or straightening by the heating element(s). Thus, the hair introduced between the arms can come into contact with the application member before being exposed to the steam and to the heating elements while the lock is being moved between the arms of the device.

Preferably, the device for treating the hair according to the invention is a straightener having flat heating elements, in particular which come into contact in the closed position.

A further subject of the invention is a refill of a device for treating the hair according to the invention.

The invention may be better understood from reading the following detailed description of non-limiting exemplary embodiments thereof and from examining the appended drawing, in which:

FIG. 1 schematically shows a perspective view of an example of a device,

Figure 3:
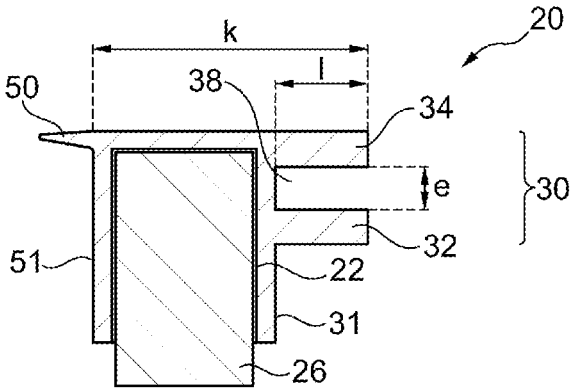
FIG. 3 is a cross-sectional view on in FIG. 2.
Figure 4:
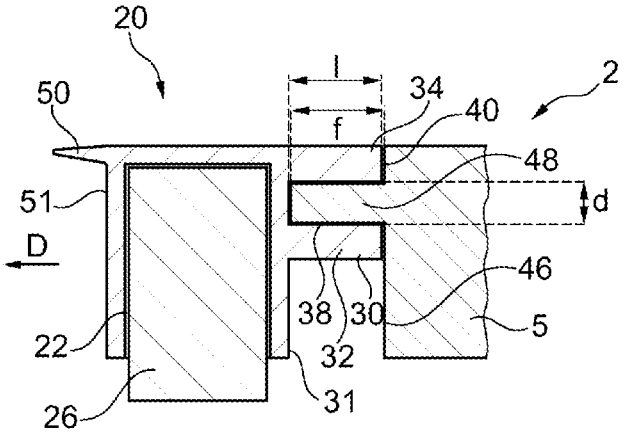
Figure 5:
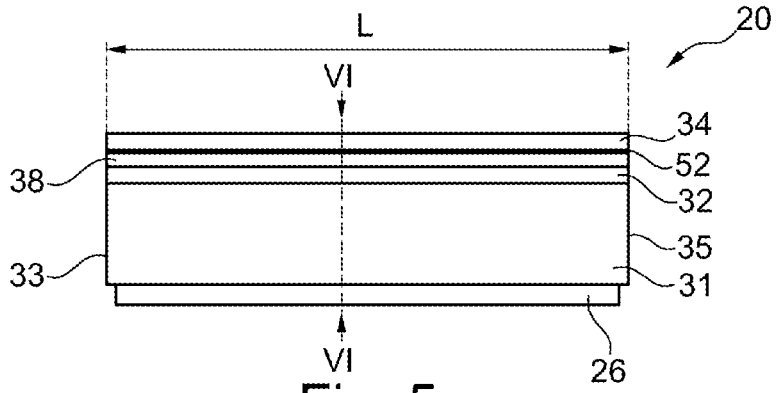
Figure 6:
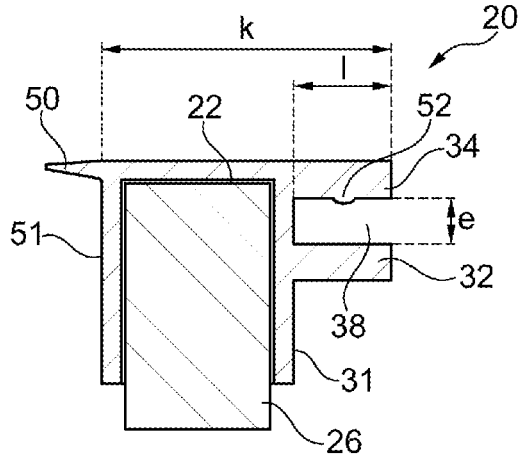
Figure 7:
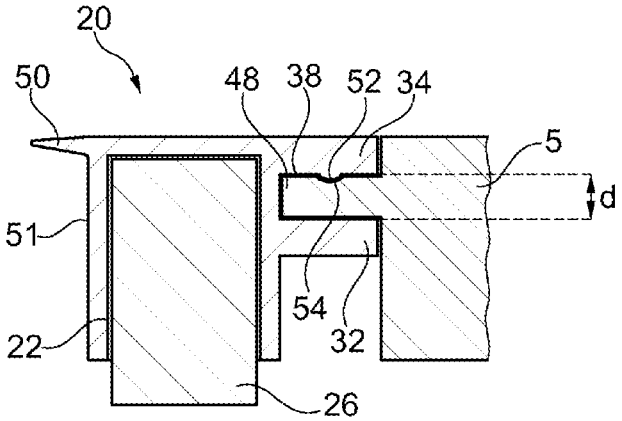
Figure 8:
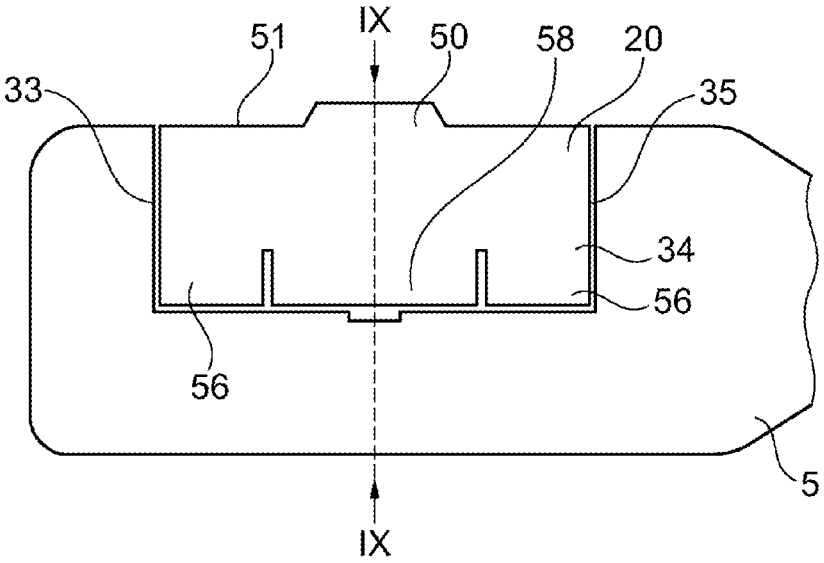
Figure 9:
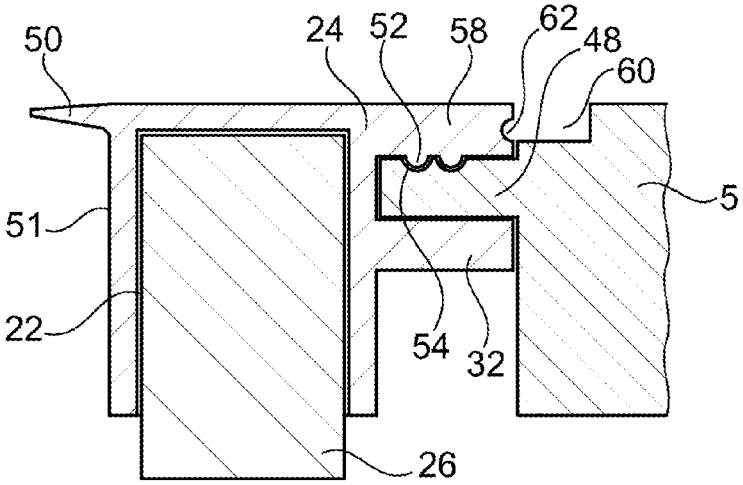
Figure 10:
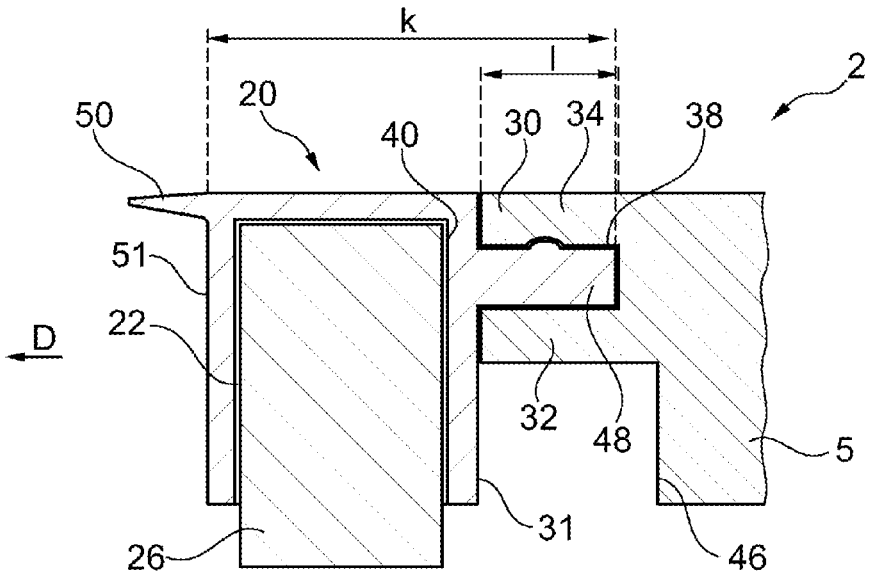
Figure 11:
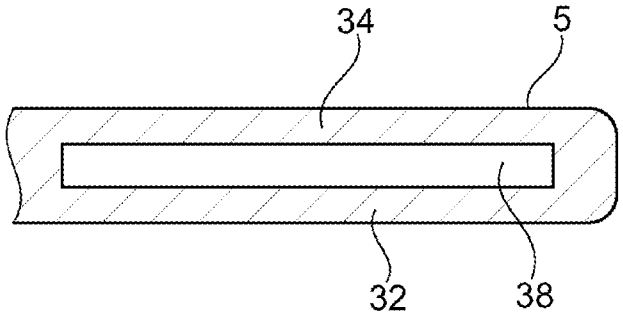

FIG. 4 is a cross-sectional view similar to FIG. 3 of an example of a device associated with the refill of FIG. 3, FIG. 5 is a schematic side view of a variant of a refill, FIG. 6 is a cross-sectional view on VI-VI in FIG. 5, FIG. 7 is a cross-sectional view similar to FIG. 6 of an example of a device associated with the refill of FIG. 6, FIG. 8 schematically and partially shows a top view of a variant of a device, FIG. 9 is a cross-sectional view on IX-IX in FIG. 8, FIG. 10 is a cross-sectional view of an example of a device, and FIG. 11 is a partial longitudinal cross-sectional view of the first arm of the device of FIG. 10.

In the rest of the description, identical or similar elements or elements having identical or similar functions bear the same reference signs in the figures, unless stated otherwise.

Figure 1:
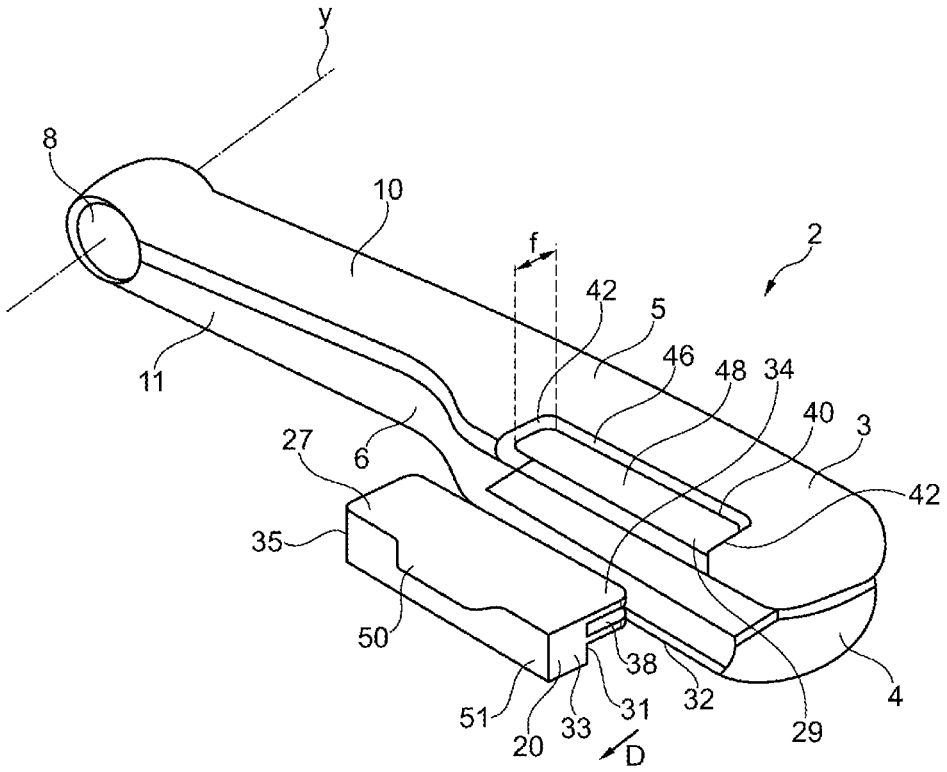
Figure 2:
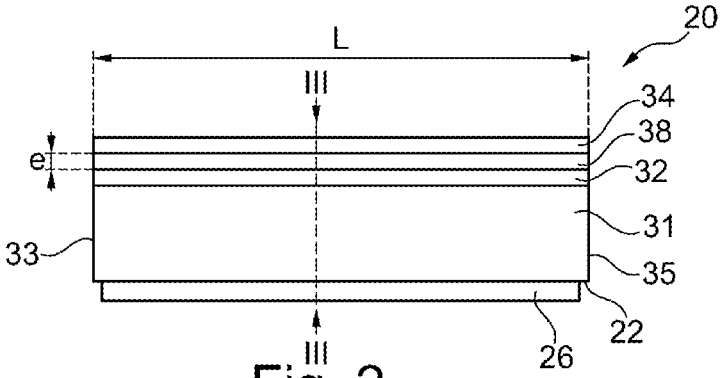
FIG. 2 is a schematic side view of an example of a refill.

FIGS. 1 and 2 show the handpiece 2 of an example of a device for treating the hair according to the invention.

This handpiece 2 has two jaws 3 and 4 that are able to move relative to one another between a spread configuration (not shown) for introduction of a lock of hair between said jaws, and a closed configuration for treatment.

The jaws 3 and 4 are carried by an upper arm 5 and a lower arm 6, respectively, which, in the example in question, are connected together at one end by a joint 8 extending along an axis of articulation Y, the handpiece 2 thus forming tongs.

The upper arm 5 and lower arm 6 each preferably have a total length of between 22 cm and 37 cm, for example equal to 31 cm, and define, between the joint 8 and the jaws 3 and 4, respective half-handles 10 and 11 on which the user can press in order to move the jaws 3 and 4 together.

An elastic return member (not visible) is preferably provided to return the jaws 3 and 4 to a spread configuration, this elastic return member being, for example, a spring disposed around an axis of the joint 8.

The invention is not limited to a particular manner of connecting the upper arm 5 and lower arm 6 together, and the jaws 3 and 4 may be rendered able to move in some other way without departing from the scope of the present invention. However, the presence of a joint is largely preferred for the ergonomics it provides.

The jaws 3 and 4 define between them a region for treating the hair, said region being intended to receive a lock of hair to be treated, the handpiece 2 being moved along said lock during the treatment, for example in the direction from the root to the end of the hair.

The handpiece 2 may be configured to apply a cosmetic product, to treat the hair using steam, and then to perform a heat treatment on the hair by contact with two hot surfaces.

The direction D of movement of the handpiece 2 over the hair, illustrated in FIGS. 1 and 4, is preferably substantially perpendicular to the upper arm 5 and lower arm 6.

The handpiece 2 is connected by a lead, in the example in question, to a base station (not shown) that is fixed during the treatment and is connected to the mains.

This base station provides electric power to the handpiece 2 and also its supply of water for generating steam, and may also carry out additional functions of processing electrical signals received from the handpiece 2. The lead that connects the handpiece 2 to the base station may thus comprise various electrical conductors and a water-supply line.

A user interface (not shown in the figures) may be present on the handpiece 2 so as, for example, to give the user the option of starting up certain handpiece components.

The cosmetic product is applied by a refill 20 carried by one of the two arms 5 or 6, in this case the upper arm 5.

The refill 20 comprises a body of substantially parallel-epipedal form that, as illustrated in FIGS. 2 and 3, has a housing 22 for an application member 26. The housing 22 and the application member 26 are of complementary form. The opening of the housing 22 is oriented toward the other 6 of the arms when the refill 20 is mounted on the arm 5, such that the application member 26 is able to come into contact with the hair engaged between the two arms 5 and 6.

The application member 26 is preferably made from a porous material, for example a felt, saturated with cosmetic product.

When the handpiece 2 is used, the application member 26 adopts the closed configuration, in contact with the hair, and applies the cosmetic product it contains to the hair. The cosmetic product is preferably in liquid form.

The length L of the refill 20 illustrated in FIG. 2 is between 10 mm and 120 mm, better still between 60 mm and 120 mm, even better between 60 mm and 100 mm.

In the example illustrated in FIGS. 1 to 4, the refill 20 comprises a first mounting means 27 interacting with a second mounting means 29 of the first arm 5 to allow the refill 20 to be mounted on the first arm 5. The first mounting means 27 is in this case a clip 30 extending perpendicularly to a lateral surface 31 of the refill 20. The clip 30 is formed by two walls 32 and 34 that extend over the entire length L of the refill 20. The two walls 32 and 34 are preferably parallel and form a space 38 between them of a thickness e of between 0.5 mm and 10 mm, better still between 1 mm and 5 mm.

The width l of the walls 32 and 34, measured from the lateral surface 31 to their end, is constant and between 0.5 mm and 50 mm, better still between 2 mm and 30 mm.

The arm 5 comprises a recess 40 for receiving the refill 20. The recess 40 is delimited by a front surface 42 and a rear surface 44 that are connected together by a lateral surface 46 defining the bottom of the recess 40. The recess 40 has a support 48 of the refill 20 forming the second mounting means 29 and having the form of a plate extending longitudinally from the front surface 42 to the rear surface 44 and transversely from the bottom 46 of the recess 40. The support 48 is of constant thickness d, as illustrated in FIG. 4, substantially equal to the thickness e of the space 38 between the walls 32 and 34 of the refill 20. The support 48 may be of a width f smaller than or equal to the width l of the walls 32 and 34, such that the refill 20 abuts against the bottom 46 of the recess 40.

In a variant, the support 48 may be of a width f greater than the width l of the walls 32 and 34, such that the support 48 abuts against the lateral surface 31 of the refill 20.

The length of the recess 40 is substantially equal to the length of the refill 20 in order that the latter fits longitudinally in the recess 40.

The refill 20 is introduced by movement along an axis substantially parallel to the axis Y of the joint 8. The walls 32 and 34 slide on either side of the support 48 until the refill 20 abuts against the bottom 46 of the recess 40 or until the support 48 abuts against the lateral wall 31 of the refill 20. The refill 20 can be kept in position by friction between the interior surfaces of the walls 32 and 34 and the upper and lower surfaces of the support 48. The space 38 is, for example, of a thickness e very slightly smaller than the thickness of the support 48. The positioning of the refill 20 in the recess 40 along the longitudinal axis of the arm 5 is ensured by the contact between the front 33 and rear 35 surfaces of the refill 20 and the front 42 and rear 44 surfaces of the recess 40.

The refill 20 may comprise a tongue 50 extending from the other of the lateral surfaces 51 of the refill 20 and perpendicularly to the latter. The tongue 50 is thus oriented toward the exterior of the handpiece 2 when the refill 20 is in the use position. A tongue 50 of this type makes it easier for the user to position the refill 20 in the recess 40 and to remove it therefrom. In fact, the user is able to grip the tongue 50 in order to push or pull on the refill 20.

The refill may have a width k, excluding the tongue, measured from its lateral surface 51 oriented toward the exterior to the end of the clip 30, substantially equal to the width of the recess 40, such that only the tongue 50 is wider than the recess 40.

The example illustrated in FIGS. 5 to 7 differs from that of FIGS. 1 to 4 in that at least one of the walls 32 and 34, and in this case the upper wall 34, has a projecting locking relief 52, and in that the support 48 has at least one hollowed-out locking relief 54 facing the projecting relief 52.

Upon positioning of the refill 20 on the arm 5, the projecting relief 52 snap-fits in the hollowed-out relief 52 and enables the refill 20 to be locked onto the support 48.

Preferably, the projecting relief 52 and the hollowed-out relief 54 are such that they prevent the walls 32 and 34 from disengaging from the support 48 under the inherent weight of the refill and such that the force the user has to employ to disengage the walls 32 and 34 of the support 48 is not excessive.

The other of the walls 32 or 34, and in this case the lower wall 32, may also comprise a second projecting locking relief (not illustrated) and the support 48 may comprise a second hollowed-out locking relief 54 facing the second projecting relief.

In a variant, the projecting relief 52 is on the support 48 and the hollowed-out relief 54 is on one of the walls 32 or 34.

The example of FIGS. 8 and 9 differs from that of FIGS. 1 to 4 in that at least one of the walls 32 or 34, in particular the upper wall 34, comprises at least one guide part 56, and in this case two guide parts 56, taking up mechanical stress and at least one locking part 58 preventing detachment of the refill 20. As illustrated in FIG. 9, the locking part 58 may comprise at least one projecting locking relief 52 intended to snap-fit into a hollowed-out locking relief 54 of the support 48.

The first arm 5 may comprise a notch 60 opening into the recess 40 and toward the exterior and the upper wall 34 may comprise a groove or a rib, and in this case a groove 62, on its end surface facing the notch 60 of the first arm 5. To unlock the refill, the user is able to slip a fingernail in the groove or under the rib by way of the notch 60 in order to slightly lift the upper wall 34 and to unlock the locking part 58 of the support 48.

The example illustrated in FIGS. 10 and 11 differs from that of FIGS. 1 to 4 in that the clip 30 extends from the arm 5 and the support 48 extends from the refill 20.

As above, one of the walls 32 or 34 may comprise a locking member interacting with a complementary locking member of the support 48 and/or the refill 20 may comprise a tongue 50.

The invention is not limited to the exemplary embodiments just described, and the features of the various examples may be combined with one another within variants that are not illustrated.

The expression "comprising a" should be understood as being synonymous with "comprising at least one", unless specified to the contrary.

The invention claimed is:

1. A device for treating the hair, comprising:

a first arm and a second arm that are connected together by a joint having a pivot axis that is perpendicular to a longitudinal axis of the device, the first arm and second arm are configured to move relative to one another about the pivot axis of the joint between a closed configuration for treating the hair and a spread configuration for engaging hair to be treated between said arms, and a removable refill comprising a body having a housing, and a member for applying a cosmetic product received in the housing, the refill comprising at least a first mounting means interacting with at least a second mounting means of the first arm, such that the first and second mounting means are assembled by a movement of the first mounting means, along an axis substantially parallel to the pivot axis of the joint, relative to the second mounting means.

2. The device as claimed in claim 1, the second mounting means having at least one surface, interacting by snap-fitting and/or friction with a corresponding surface of the first mounting means.

3. The device as claimed in claim 1 or 2, one of the first mounting means and of the second mounting means, comprising two facing walls that between them enclose a support of the other of the first mounting means and of the second mounting means.

4. The device as claimed in claim 3, the two walls being substantially parallel, for example spaced apart by a distance e of between 0.5 mm and 10 mm.

5. The device as claimed in claim 1, the first mounting means comprising a locking member snap-fitting with a complementary locking member of the second mounting means.

6. The device as claimed in claim 3, wherein at least one of the walls comprises at least one guide part taking up mechanical stress and at least one locking part preventing detachment of the refill.

7. The device as claimed in claim 6, the first arm or the refill that carries the support comprising at least one notch for manually unlocking the locking part.

8. The device as claimed in claim 3, the support being of a constant thickness d substantially equal to the distance e between the two walls.

9. The device as claimed in claim 1, the first mounting means being the same length as the second mounting means and/or extending over a length substantially equal to the length of the refill.

10. The device as claimed in claim 1, the first mounting means having a width l of between 0.5 mm and 50 mm.

11. The device as claimed in claim 1, the second mounting means having a width substantially equal to or greater than that of the first mounting means.

12. The device as claimed claim 1, the housing of the application member being oriented toward the second arm.

13. The device as claimed in claim 1, the first arm comprising a recess, which receives the refill, and in which the first and the second mounting means extend.

14. The device as claimed in claim 1, the refill comprising a tongue extending along a surface of the refill oriented toward the exterior of the device when the refill is mounted on the first arm.

15. A refill comprising a body having a housing, and a member for applying a cosmetic product received in the housing, the refill being configured to be removably mounted on a device comprising a first arm and a second arm that are connected together by a joint having a pivot axis that is perpendicular to a longitudinal axis of the device, the first arm and second arm are configured to move relative to one another about the pivot axis of the joint between a closed configuration for treating the hair and a spread configuration for engaging hair to be treated between said arms, the refill comprising at least a first mounting means interacting with at least a second mounting means of the first arm of the device, such that the first and second mounting means are assembled by a movement of the first mounting means, along an axis substantially parallel to the pivot axis of the joint, relative to the second mounting means.

* * * * *